United States Patent [19]

Baus

[11] Patent Number: 4,882,795

[45] Date of Patent: Nov. 28, 1989

[54] PARTITION, MORE PARTICULARLY FOR A CORNER SHOWER

[76] Inventor: Heinz G. Baus, Wartbodenstrasse 35, CH-3626 Hünibach-Thun, Switzerland

[21] Appl. No.: 297,284

[22] Filed: Jan. 17, 1989

[30] Foreign Application Priority Data

Jan. 14, 1988 [DE] Fed. Rep. of Germany ..... 3800828

[51] Int. Cl.[4] ..... A47K 3/22; A47K 7/00

[52] U.S. Cl. ..... 4/607; 4/557; 4/614; 49/40; 49/370; 160/88; 160/201; 160/214

[58] Field of Search ..... 4/557, 596, 607, 610, 4/612, 614; 49/41, 409, 410, 40, 370; 160/88, 214, 201

[56] References Cited

U.S. PATENT DOCUMENTS

| | | | |
|---|---|---|---|
| 520,526 | 5/1894 | Homer | 160/201 |
| 3,422,464 | 1/1969 | O'Brien | 4/154 |
| 4,807,312 | 2/1989 | Baus | 4/607 |

FOREIGN PATENT DOCUMENTS

| | | | |
|---|---|---|---|
| 8114929 | 10/1981 | Fed. Rep. of Germany . | |
| 3148024 | 6/1983 | Fed. Rep. of Germany . | |
| 3309606 | 9/1984 | Fed. Rep. of Germany . | |
| 8416939 | 1/1985 | Fed. Rep. of Germany . | |
| 8512641 | 8/1985 | Fed. Rep. of Germany . | |
| 020473 | 1/1908 | Norway | 49/41 |

*Primary Examiner*—Henry J. Recla
*Assistant Examiner*—Keith Kupferschmid
*Attorney, Agent, or Firm*—Foley & Lardner, Schwartz, Jeffery, Schwaab, Mack, Blumenthal & Evans

[57] ABSTRACT

A partition, more particularly for a corner shower, contains two door-elements mounted displaceably in an upper guide-rail. In the vicinity of the entrance, the upper guide-rail is curved like the edge of the tub and is connected to two lateral wall elements which are secured to the room and are flat. The purpose of the invention is to achieve reliable sealing and equally reliable guidance combined with a simple design. It is proposed that the guide-rail be curved over its entire length and comprise curved end-parts behind the flat wall-element. No lower guide-rail is provided. Instead, small narrow guide-elements are located outside the entrance.

20 Claims, 4 Drawing Sheets

PARTITION, MORE PARTICULARLY FOR A CORNER SHOWER

BACKGROUND OF THE INVENTION

1. Field of the invention

The present invention relates to a partition, more particularly for a corner shower, with two door-elements by means of which an entrance can be closed or opened, with a curved guide-rail in the vicinity of the entrance in which the door-elements are mounted displaceably by means of guide-elements, and with two preferably flat wall-elements, arranged laterally of the entrance, with which the guide-rail is connected.

2. Description of the Prior Art

Known from German Patent No. 33 09 606 is a partition of this kind which comprises, in the vicinity of the entrance, a curved upper guide-rail for the door-elements. A lower guide-rail is arranged accordingly at the lower edge of the door-elements. Four door-elements are provided, each two being hinged together at their longitudinal edges. All in all, the four door-elements require a large number of individual parts, involving corresponding manufacturing and production low costs. In the case of such partitions, there is the problem that shower-tubs produced by different manufacturers frequently differ as to details, more particularly as to the radius of curvature and the width of the entrance. This makes it necessary to produce and stock a large number of partitions involving high production and storage costs.

German Utility Model No. 85 12 641 discloses a shower stall comprising a prefabricated, hollow, cylindrical unit. This consists of annular parts adapted to be placed one upon the other, a closed floor-plate and a closed ceiling plate being provided. The entrance may be closed or opened by means of a curved sliding door having a radius of curvature corresponding to that of the stall. Because of the stall, it is impossible to adapt the door to different radii of curvature or sizes.

German Utility Model No. 84 16 939 reveals a shower-stall having an approximately square bare comprising upwardly open U-shaped guide-rails for two suspended doors which are guided at their upper ends selectively by means of an annular, downwardly open U-shaped rail, or a U-shaped telescoping rail or telescoping arm per sliding door. Guides of this kind which are stable and function reliably are costly to produce.

Furthermore, a door-system for a telephone-box having a polygenal base and a single door-element is known from German OS No. 31 48 024. The upper guide-rail is curved externally of the entrance and runs, over a not inconsiderable part of its length, upon the adjacent wall-element. The end of the profiled rail is nor connected to the first wall-element which is adjacent the entrance, but to a second polygonally arranged wall-element. The door terminates above the floor of the telephone-box and additional measures are required to provide the sealing needed with shower-partitions. Arranged at the lower edge of the door-element is a guide-profile in which a stationary roller, arranged externally of the entrance, runs. The door-element itself is substantially flat and the guide-profile is a downwardly open U-shaped rail. This rail is curved and, except for the bent end-areas of the door, is at a corresponding distance therefrom. The said roller is arranged on the floor and there is a not inconsiderable gap between the floor and the lower edge of the door.

Moreover, U.S. Pat. No. 3,422,464 discloses a partition comprising a lower guide-rail behind a curved tub-edge. Arranged displaceably in this lower guide-rail, and in the correspondingly curved upper guide-rail, are narrow lamallae. Located between each two adjacent lamallae is a flexible track. Upon opening, the lamellae are pushed to one side, the tracks being folded together like a shower-curtain. A partition of this kind is quite difficult to manipulate and to clean.

Finally, German Utility Model No. 81 14 929 discloses a shoe with two rollers which is to be attached to the upper edge of a sliding door. This element is made in two pieces, namely an upper holder for the rollers and a lower assembly-angle. The roller-holder is connected to the said assembly-angle in such a manner as to pivot about a vertical bearing pin.

OBJECTS OF THE INVENTION

Base upon the foregoing, it is an object of the invention to develop a partition of this kind by reducing the number of individual parts and assembly-costs in order to achieve satisfactory production costs. Stable and reliable guidance of the door-elements is also to be assured, and little force is to be needed to open and close the entrance reliably. There is to be no escape of splashing water and simple sealing is to be provided, especially in the vicinity of the entrance, between the edge of the tub and the door-elements. The user is to be able to pass unobstructedly through the entrance and, in the interests of long life and reliability, the entrance-area is to be kept largely free from guide-means for the door-elements.

SUMMARY OF THE INVENTION

According to the present invention, there is provided a partition for a shower tub, with door-elements by means of which an entrance can be closed and opened, two wall-elements, each arranged between a door-element and a room-wall, comprising:

an upper curved guide rail connected to the wall-elements, and in which the door elements are displaceably mounted, the guide-rail comprising curved end-parts located behind the wall-elements, each end-part having a free end located at a predetermined distance from a corresponding wall-element, and a guide-element for the lower edge of each door element, the guide-element being located externally of the entrance.

Preferably, the partition comprises two door elements and the entrance has a bottom which is defined by an edge of the shower-tub.

The proposed partition is noted for its stable and reliable design. Smooth guidance of the door-elements is also assured.

In a preferred embodiment, only two curved door-elements are provided and, in order to open the entrance, these are pushed in each direction behind the respective wall-element. The two door-elements are suspended only from the upper guide-rail which is curved over its entire length. There is no lower guide-rail for the lower edges of the door-elements. The entrance is therefore not obstructed in any way by such a lower guide-rail. Unlike designs which comprise a lower guide-rail, there is thus no danger of the rail being damaged by the user, or by a falling object, thus putting the partition out of action. On the other hand, the guide-element is provided outside the entrance and is arranged behind and below the edge of the tub. By "behind" we should understand the inner space of the tub, when one stands to take his shower.

Preferably, a guide-element is in the form of an upwardly open U in which the lower edge of a door-element engages. Such a guide-element is preferably narrow in the horizontal direction and extends over only a part of the width of the wall element. The guide-element is only a few centimeters in width and/or it is substantially of the same width as the vertical profiled rail of the wall-element, which rail defines the entrance.

Preferably, the two lateral wall-elements are made flat but may also be corrugated or be curved differently from the entrance, whereas the guide-rail exhibits, over its entire length, i.e. even in the end-areas, the same radius of curvature and the door-elements are made, coaxially in relation to the guide-rail, with a correspondingly reduced radius of curvature.

The free end-part of the guide-rail is spaced from the relevant wall-element in a horizontal plane. If the wall-element is made flat, then the distance between the guide-rail and the wall-element, remote from the entrance, is always greater. In the case of a corrugated wall-element also, the distance between the free end of the guide-rail and the wall-element is substantially greater than the comparable distance in the immediate vicinity of the entrance. The free end-part, spaced from the relevant wall-element of the guide-rail is preferably connected to the wall-element by means of the holding means. This provides additional stiffening in the vicinity of the upper edge of the wall-element. This stiffening promotes the stability of the partition, the overall design of which is stable and reliable in operation.

Preferably, the lower edges of the door-elements, more particularly the lower horizontal profiled rails thereof, are below the upper surface of the edge of the shower-tub. This provides protection against splashing with no additional structural parts.

At least in the vicinity of the entrance, an inner wall of the tub runs preferably substantially vertically, so that a front wall of the lower edge of a corresponding door-element, front wall which is directed outwardly, is curved, and runs vertically, is arranged at a short distance only from the inner wall of the edge of the shower-tub. There is thus only a narrow gap between the lower edge of the door-element and the edge of the tub. The escape of splashes from the tub is thus reliably prevented without any additional seals.

As already indicated, the single upper guide-rail is curved over its entire length, even at the end-parts located outside the entrance. Close to the vertical boundary of the entrance, the upper guide-rail is secured to the flat wall-element, preferably by means of screws, the end-part thereof projecting increasingly from the flat wall-element. The projecting end of the profiled rail is preferably connected, with the holding means, to the wall-element, thus assuring a stable attachment and mounting for the guide-rail. This curved end-part, projecting beyond the shower-tub according to the radius of curvature, does not interfere in any way with the taking of a shower, since the upper edges of such partitions are arranged between 1.7 and 2 m above the edge of the tub. If a corresponding lower guide-rail were present, the end-parts thus curved over the shower-tub would interfere with the user and might even be dangerous. However, such problems do not arise since, there is no lower guide-rail but only the previously mentioned small lower guide-element is provided.

BRIEF DESCRIPTION OF THE DRAWINGS

Preferred embodiments of the invention will now be described, as examples, without limitative manner, having reference the attached drawings, wherein.

DESCRIPTION OF AN EXEMPLARY EMBODIMENT

Figure 1:
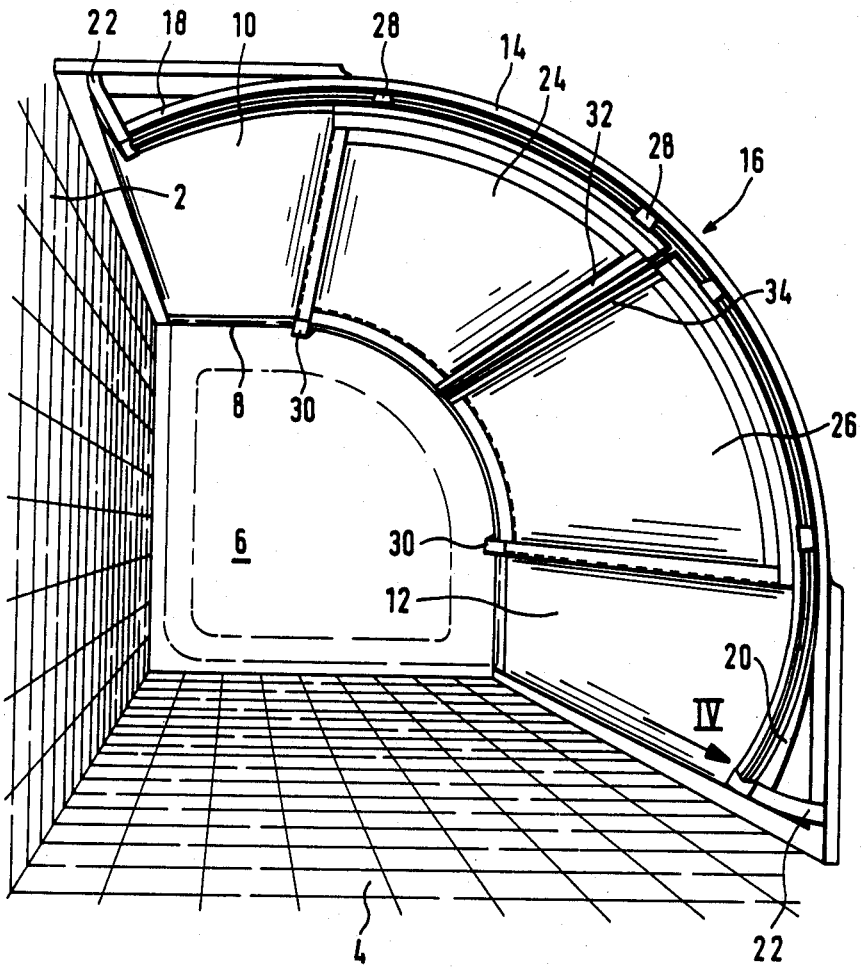
FIG. 1 is a perspective view from above of the partition installed in a corner over a shower-tub.

Referring to the Figures, FIG. 1 shows a shower-tub 6 fitted into a corner between two room-walls 2,4 running at right angles to each other. This shower-tub is installed in the usual manner upon the floor of a bathroom or a shower-stall. The partition is arranged over the front free edge 8 of the shower-tub, with two lateral stationary wall-elements 10,12. The wall-elements 10,12 are flat, but the invention also covers curved or corrugated wall-elements. They are connected, in the usual manner, by compensating profiles to room-walls 2, 4, respectively. A single upper guide-rail 14 is provided, but the usual lower guide-rail is missing. The upper guide-rail 14 is curved over its entire length, with a constant radius of curvature. The guide-rail 14 is thus curved not only over the entrance 16 but also behind the flat wall-elements 10,12. End-parts 18,20 of the upper guide-rail 14, located behind the upper edges of the wall-elements 10,12, have their ends connected by holding parts 22 to the respective wall-elements 10,12. The end-parts 18,20 projecting inwardly over the shower-tub 6 from the wall-elements 10,12, do not interfere with the taking of a shower since the upper guide-rail 14 is arranged considerably above the shower-tub 6, usually at a distance of between 1.7 and 2 m. Since there is no corresponding lower guide-rail, there is nothing on the floor to impede or endanger the user of the shower-stall.

As shown, the entrance 16 is closed off by means of two door-elements 24,26. These elements are suspended from, and guided by, two guide-bodies 28 in the guide-rail 14. In order to open the entrance 16, the door-elements 24,26 are each pushed aside behind the stationary wall-elements 10,12. A narrow, hook-like guide-element 30, to be explained hereinafter, is located at the edge of the entrance 16 for the door-elements 24,26. The radius of a door-element 24 or 26 is greater than that of curved edge 8 in the vicinity of the entrance. The radius of curvature of the totally curved upper guide-rail 14 is correspondingly greater. This provides a satisfactory seal between a door-element 24 or 26 and the edge of the tub and also makes it possible to shorten the holding parts 22. It also ensures that each door element 24 or 26 is correctly aligned with, and supported by, the inner wall 41 of the edge 8. As a result of this greater radius of curvature, each door-element 24 or 26 does not bear at any possible point, for example centrally, against the inner wall 41 of the edge 28; instead, each door-element 24 or 26 bears against the inner wall 41 substantially only in the vicinity of the front vertical profiled rail 32,34. The inner wall 41 of the curved edge 8 runs, in the vicinity of the entrance 16, substantially vertically, at least above the vertical distance between the lower edge 45 of a door element 24 or 26 and the upper limit of the edge 8.

Figure 2:
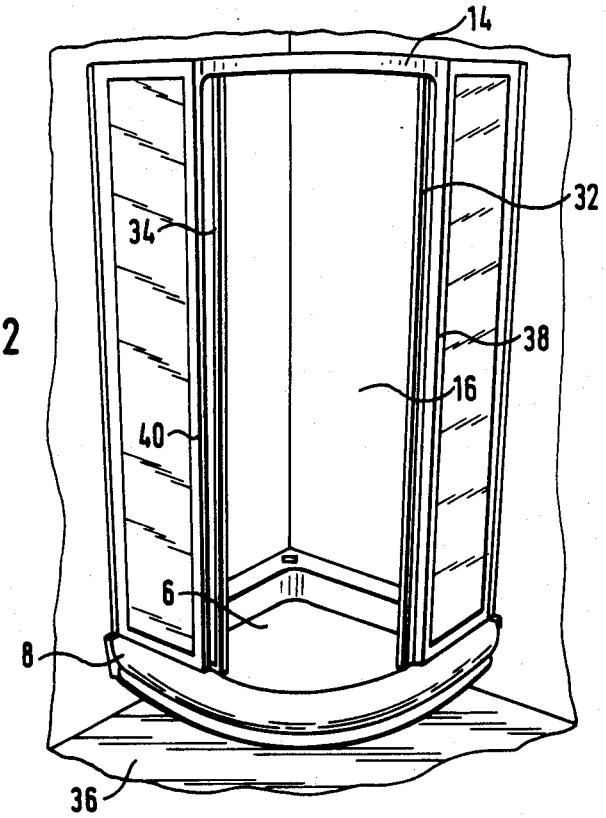
FIG. 2 is a view from the front, with the door-elements open.

FIG. 2 is a view of the partition with the entrance open, only vertical profiled rails 32,34 of the two door-elements 24,26 being visible. The shower-tub 6 is mounted upon, and secured to the floor 36 in the usual manner by means not shown; the facing tiles, or the like, provided below the edge 8 of the tub, have not yet been fitted. The top of the entrance 16 is defined by the guide-rail 14 and the bottom by the edge 8 by the tub. There is no lower guide-rail and the user can therefore pass freely into the shower-tub. Furthermore, the usual dangers of damage and the hindrance, resulting from a lower guide-rail, are thus eliminated. Connected to the vertical profiles 38,40 of the wall-elements 10,12 at the bottom are the narrow hook-like guide-elements 30 (see FIG. 3) which are thus located externally of the entrance and do not interfere in any way.

Figure 3:
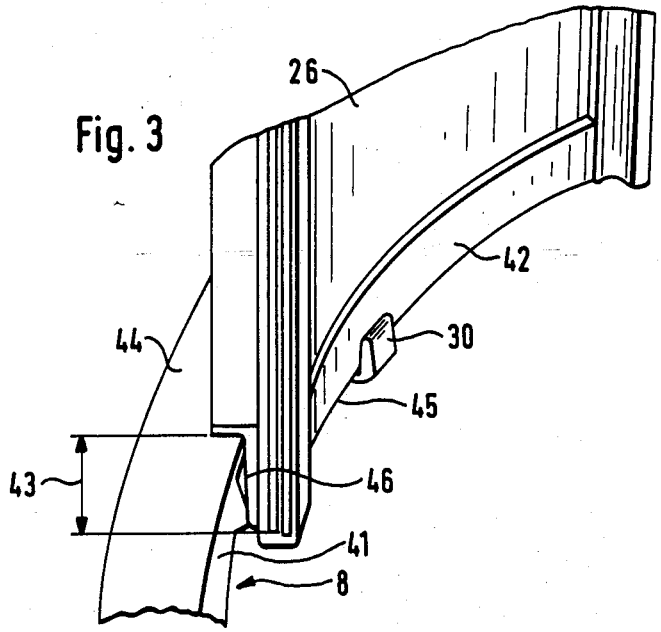
FIG. 3 shows the lower part of a door-element to an enlarged scale.

FIG. 3 shows, to an enlarged scale, the door-element 26 which has been pushed partly behind the stationary wall-element; the hook-like lower guide-element 30 is also quite visible, being connected to the lower end of the vertical profile of the wall-element. The guide-element 30 is made of plastic and has an upwardly-open, U-shaped cross-section so that the entire lower horizontal profiled rail 42 engages from above in this guide-element 30. The guide-element 30, and also the lower edge 45 of the door-element 12, and the above-mentioned lower horizontal profiled rail 42, are located below the upper edge or surface 44 of the edge 8 of the tub 6. In the closed condition, therefore, sealing against splashes is assured. In order to reduce friction between the door-element 26 and the edge of the tub, a sliding part 46 is arranged at the lower end of the vertical profiled rail 34. At least over a height 43, the inner wall 41 of the edge 8 runs substantially vertically and, according to the invention, there is a narrow gap, extending over this height 43, between the edge 8 of the tub 6 and the door-element 26. The lower edge 45 of the door-element 26 is lower, by the height 43, than the upper surface 44 of the edge 8. This suitably predetermined height 43, and the narrowness of the gap between the door-element 26 and the edge 8, definitely prevents the escape of any splashes.

Figure 4:
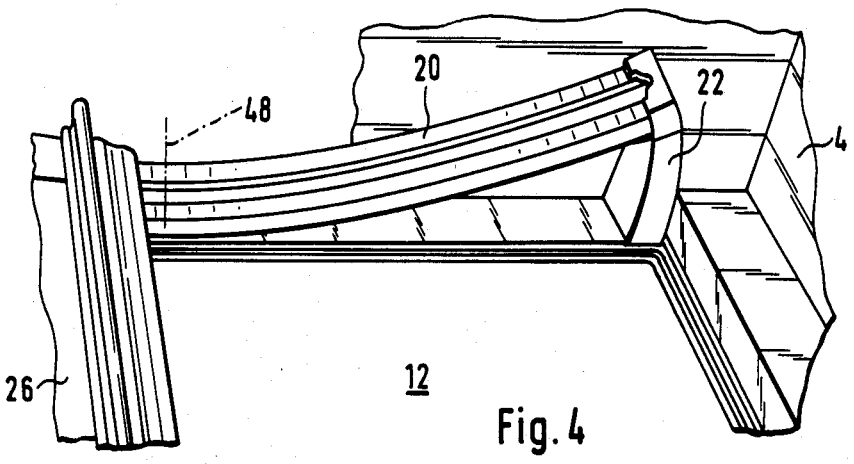
FIG. 4 is a view from below of the curved end-part of the upper guide-rail as seen in direction IV according to FIG. 1.

FIG. 4 is a view from below of the curved end-part 20 of the guide-rail 14. The end-part 20 extends substantially over the entire width of the wall-element 12, the distance between the end-part 20 and the wall-elements 12, starting from the entrance, increasing continuously. The free end of the end-part 20 is secured, by means of the holding part 22, to the wall-element 12 in the vicinity of the room-wall 4. Moreover, the guide-rail 14, which is in the form of a hollow section, is connected, at the edge of the entrance, to the wall-element 10, more particularly by means of a screw, as indicated by broken line 48.

Figure 5:
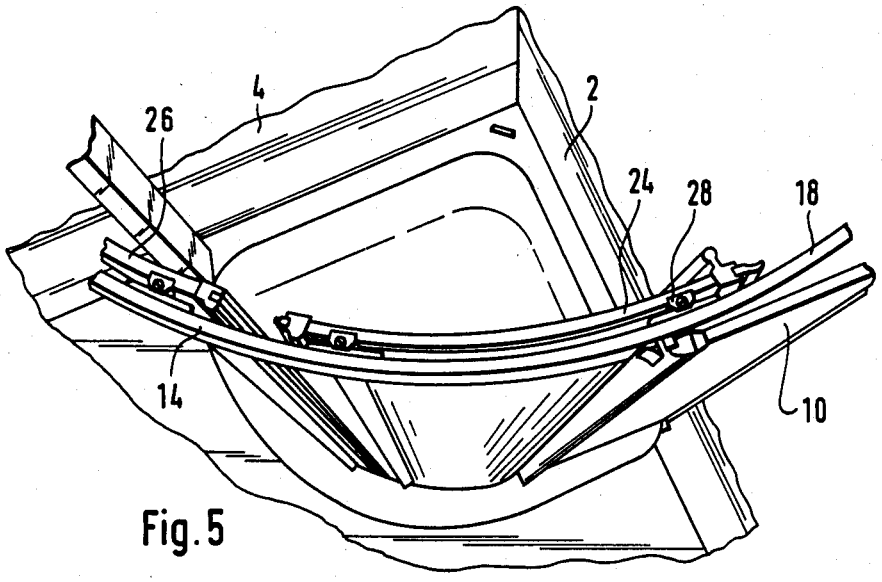
FIG. 5 is a view of a part of the partition from above.
Figure 6:
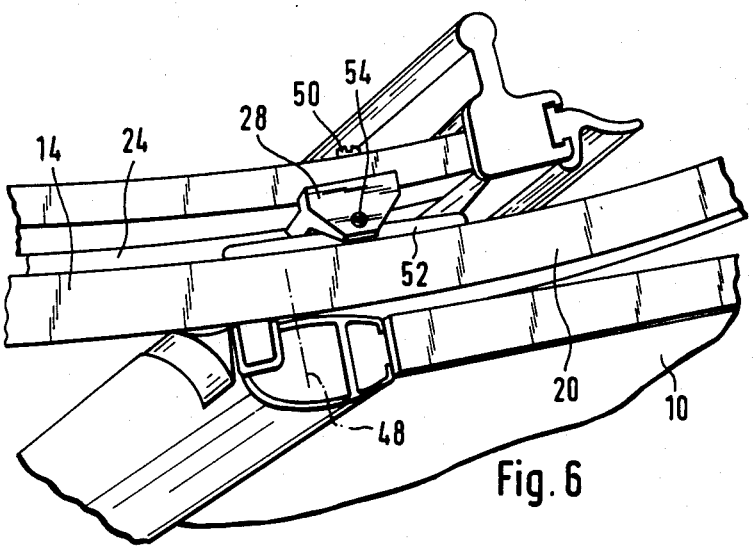
FIG. 6 shows a section of FIG. 5 to an enlarged scale.

FIGS. 5 and 6 show a part of the guide-rail 14 and also the door-element 24, with the entrance only slightly open. The door-element 24 is suspended from, and guided in, the guide-rail 14 by means of guide-bodies 28 which engage in the guide-rail 14 from behind by means of rollers not shown. The guide bodies 28 are connected by means of screws 50 to the upper horizontal profiled rail of the door-element 24. The rollers are arranged upon a rocker 52 which is adapted to pivot about a vertical axis 54 in relation to guide-body 28. This provides stable guidance and suspension. It also ensures that the door-element 24 is smoothly displaceable.

Figure 7:
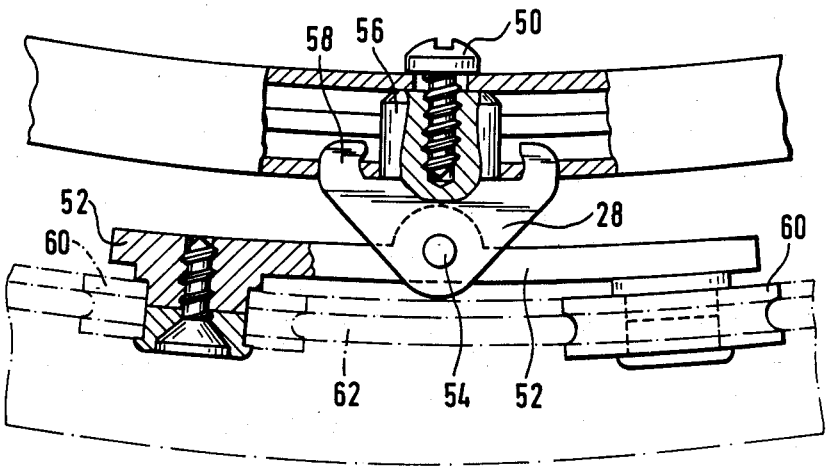
FIG. 7 shows the upper guide-rail partly in plan view and partly in section.

FIG. 7 shows, to an enlarged scale and in partial cross-section, a view from above of a guide-body 28 which is secured, by means of the screw 50 in the upper horizontal profiled rail of the door-element 24,26. The guide-body 28 is secured against rotation so that axis 54 may be set truly vertical. The guide-body 28 comprises a central part 56 which engages in a bore in the upper profiled rail of the door-element 24 and into which the screw 50 is screwed. In order to prevent rotation, the guide-body 28 contains a supporting part 58 which bears upon the upper edge of the profiled rail, as may be seen in conjunction with FIG. 6. Arranged rotatably at each end of the rocker 52 is a guide-roller 60. The guide-rollers 60 engage from behind in the upper guide-rail 14 and roll upon the track 62 thereof.

Although the invention was described hereinabove with a certain degree of particularity, it is understood that the present disclosure has been made only by way of example and that numerous changes in the details of construction and the combination and arrangement of parts may be resorted to without departing from the spirit and the scope of the invention as hereinafter claimed.

I claim:

1. In a partition for a shower tub, said partition including door-elements and two wall-elements defining an entrance into which said door-elements are slideable mounted to close and open said entrance, each of said wall-elements adapted to be arranged between said door-elements and a room-wall, the improvement comprising:

an upper curved guide-rail connected to said wall-elements, and in which said door elements are displaceably mounted, said guide-rail comprising curved end-parts located behind said wall-elements, each end-part having a free end located at a predetermined distance from a corresponding wall-element, and a guide-element for the lower edge of each door element, said guide-element being located laterally of said entrance.

2. A partition according to claim 1, comprising two door elements and wherein said entrance has a bottom which is defined by an edge of said shower-tub.

3. A partition according to claim 2, wherein said each end-part is connected to a corresponding wall-element by holding means.

4. A partition according to claim 3, wherein each door element has a lower horizontal profiled rail which is located behind said edge of the shower-tub and below an upper surface thereof.

5. A partition according to claim 3, wherein said lower edge of each door element is located behind said edge of the shower-tub and below an upper surface thereof.

6. A partition according to claim 5, wherein said wall elements are flat and wherein said predetermined distance of each end-part from a corresponding wall element increases from a door-element towards a corresponding room-wall.

7. A partition according to claim 6, wherein said guide-element is a narrow element in a horizontal direction and is arranged behind and connected to a vertical profile of a corresponding wall-element.

8. A partition according to claim 7, further comprising guide-bodies connected to said upper guide-rail, and arranged at a predetermined distance from a vertical longitudinal edge of a corresponding door-element, each door-element being displaceably mounted in and guided by said guide-bodies.

9. A partition according to claim 8, wherein each of said guide-bodies is arranged at a predetermined distance from a vertical profiled rail of a corresponding door-element, said profiled rails coming adjacent to each other when said door-elements are closed.

10. A partition according to claim 8, wherein each of said guide-bodies comprises a rocker adapted to rotate about a vertical axis, two guide-rollers, spaced horizontally apart, being screwed rotatably to said rocker.

11. A partition according to claim 10, wherein each guide-body is secured against rotation by means of a supporting surface which bears upon an upper horizontal profiled rail of a door-element for a vertical alignment of said vertical axis.

12. A partition according to claim 11, wherein each of said guide-bodies comprises a central part which engages in a bore in said upper horizontal profiled rail of a corresponding door-element, into said bore a connecting means being inserted.

13. A partition according to claim 7, wherein said guide-element is arranged behind and below said edge of the tub, said guide-element being in the form of a hook-like upwardly open U element.

14. A partition according to claim 3, wherein said edge of said shower-tub has an inner wall, which is substantially vertical at least at the vicinity of said entrance, and wherein, in a closed position of said door-elements, a narrow gap is provided between said inner wall of said shower-tub and a front wall of said lower edge of each door-element, said gap having a predetermined vertical height.

15. A partition according to claim 3, wherein said door-elements have substantially the same width as said wall-elements.

16. A partition according to claim 3, wherein each of door-elements has a radius larger than that of said edge of said shower-tub, which edge is curved in the vicinity of said entrance, each door-element bearing against an inner wall of said curved edge of said shower-tub only in the vicinity of front vertical profiled rails of said door-elements, said front vertical profiled rails coming adjacent to each other when said door-elements are closed.

17. A partition according to claim 3, which is free of a lower guide-rail, and wherein said two door-elements are curved and are suspended only from said upper guide-rail which is curved over its entire length.

18. A partition according to claim 17, wherein said guide-rail is curved with a constant radius of curvature.

19. A partition according to claim 18, wherein said guide-rail has the same radius of curvature as said edge of said shower-tub.

20. A partition according to claim 19, wherein in order to reduce friction between a door-element and said edge of said shower-tub, a sliding part is arranged between a lower end of a vertical profiled rail of a door-element and an inner wall of said edge of said shower-tub.

* * * * *